United States Patent [19]

Kjelgaard et al.

[11] Patent Number: 4,715,528

[45] Date of Patent: Dec. 29, 1987

[54] RECLOSABLE OPENING ARRANGEMENT ON A PACKING CONTAINER

[75] Inventors: Tom Kjelgaard, Löddeköpinge; Anders Hallberg, Lund; Kenth Jacobsson, Södra Sandby, all of Sweden

[73] Assignee: Tetra Pak International AB, Lund, Sweden

[21] Appl. No.: 905,157

[22] Filed: Sep. 9, 1986

[30] Foreign Application Priority Data

Sep. 20, 1985 [SE] Sweden ..... 8504351

[51] Int. Cl.[4] ..... B65D 5/72

[52] U.S. Cl. ..... 229/123.1; 220/359; 206/631.1

[58] Field of Search ..... 229/17 R, 124, 7 R, 229/43; 220/269, 270, 359

[56] References Cited

U.S. PATENT DOCUMENTS

| | | | |
|---|---|---|---|
| 3,187,977 | 6/1965 | Graybill | 229/17 R |
| 3,896,965 | 7/1975 | Cornell | 220/359 |
| 3,900,155 | 8/1975 | Rausing et al. | 229/7 R |
| 3,977,591 | 8/1976 | Martensson et al. | 229/7 R |
| 4,113,103 | 9/1978 | Carlsson | 229/7 R |
| 4,126,263 | 11/1978 | Martensson | 229/17 R |
| 4,223,789 | 9/1980 | Reil | 229/7 R |
| 4,258,876 | 3/1981 | Ljungcrantz | 229/43 |
| 4,544,093 | 10/1985 | Stark et al. | 220/359 |

FOREIGN PATENT DOCUMENTS

| | | | |
|---|---|---|---|
| 613932 | 2/1961 | Canada | 229/17 R |
| 136811 | 11/1977 | Denmark . | |
| 0001134 | 3/1979 | European Pat. Off. | 229/17 R |
| 1134 | 3/1979 | European Pat. Off. . | |
| 2758092 | 6/1979 | Fed. Rep. of Germany . | |

*Primary Examiner*—Willis Little

*Attorney, Agent, or Firm*—Burns, Doane, Swecker & Mathis

[57] ABSTRACT

An opening arrangement on a packing container of the type which comprises a pouring opening 6 formed in the upper side of the container. The opening arrangement comprises a cover strip 8 and a pouring edge strip 7 arranged between the cover strip 8 and the packing container. To make possible the reclosure of the pouring opening 6 the cover strip 8 is provided with a gripping strip 9' sealed to its underside which preferably has a free gripping edge 9'' facilitating the hooking of the cover strip 8 to the pouring tab 7.

13 Claims, 6 Drawing Figures

Fig. 3
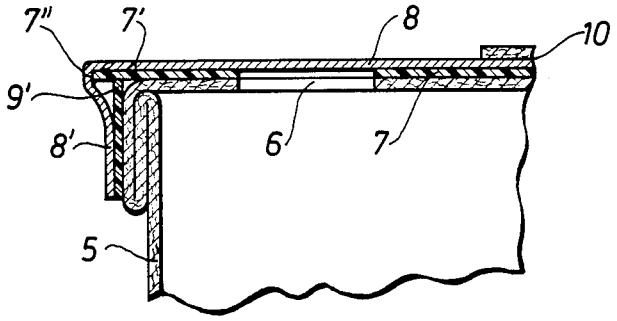
Fig. 5a
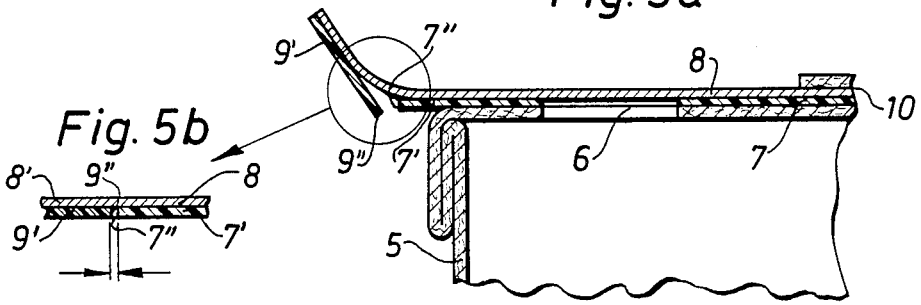
Fig. 5b
Fig. 4
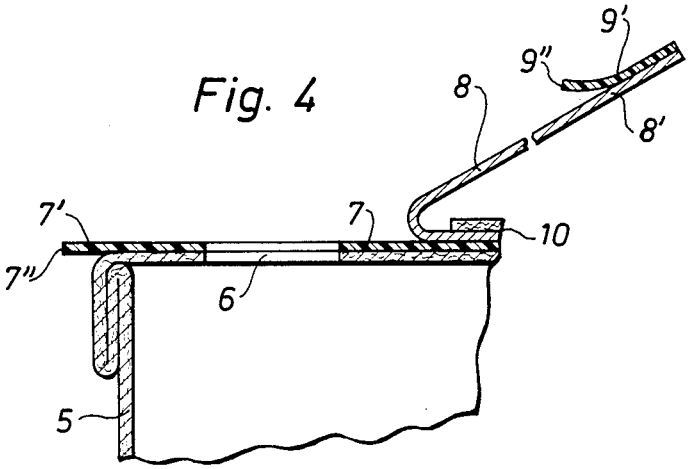

RECLOSABLE OPENING ARRANGEMENT ON A PACKING CONTAINER

FIELD OF THE INVENTION

The invention relates generally to packing containers and, more particularly, to an opening arrangement on a packing container with an emptying opening, prepared in a container wall.

BACKGROUND OF THE INVENTION

So-called non-returnable packages for, for example, beverages or similar liquid foodstuffs are usually manufactured from plastics-coated paper or similar packing laminate which by means of conventional folding and sealing operations can be formed to parallelepipedic packing containers. Such a known parallelepipedic container is TetraBrik (registered trade-mark) which on its top side may have a prepared emptying opening, preferably placed adjoining a corner edge, with a pouring tab facilitating the emptying of the contents projecting over the container edge in connection with the emptying opening. The emptying opening and the pouring tab are preferably covered by a strip as an openable seal to the top side of the container and which with its front end (gripping tab) extends over the container edge all around the projecting pouring tab. Packing containers of the type described here are known, for example, from DK patent specification No. 136 811, U.S. Pat. No. 4,126,263 and EP No. A2 0 001 134. DE OS No. 2 758 092 also describes a similar packing container. When such a container is to be emptied of its contents, the seal of the strip against the upper side of the container is broken by pulling the strip with the help of the gripping tab upwards and backwards over the emptying opening which consequently is exposed.

The packing container described has a series of substantial advantages both in respect of manufacture and from a point of view of application. It is simple, inexpensive and easy to manufacture in fast-operating packing machines and offers flexible possibilities of distribution and storage. It has, moreover, good handling characteristics and allows the emptying of the contents in a well-concentrated and easily directable jet. In glaring contrast to these advantages, however, appears the imperfect facility of the container for reclosure of the emptying opening once exposed, which, of course, is particularly serious in cases where the container is large and holds more contents then the amount required for use just at the moment and therefore requires a tolerably "safe" storage of the contents between occasions of emptying.

Reclosing cover strips for container openings are certainly known in themselves and generally some type of adhesive coating is used on the side which faces the container opening. Such sticky cover strips function well in cases where the container material is sufficiently resistant to tearing so as not to tear off and attach itself to the sticky surface when the cover strip is pulled off. Not much success has been achieved, on the other hand, using these cover strips with packing material of the type consisting of paper with thin plastic coatings, but the use here has been limited to container material of sheet metal, aluminium etc. which is especially resistant to tearing.

Reclosable cover strips of the "press fastener type" have also been tried, but this type too makes demands on the mechanical strength of the container material and is less well suitable, therefore, for relatively easily deformable material as represented by packing laminate of the type consisting of paper with thin plastic coatings.

OBJECTS AND SUMMARY OF THE INVENTION

It is an object of the present invention, therefore, to make possible and furnish an opening arrangement on a packing container which has the advantageous handling and pouring characteristics of the container described earlier and which at the same time offers good facilities for reclosure of the package opening without the limitations affecting the known technique.

Such a packing container is made possible in accordance with the present invention in that the cover strip is provided with gripping elements in the form of a strip applied to the underside of the cover strip to provide detachable gripping of the pouring tab so as to retain the cover strip in closed position.

BRIEF DESCRIPTION OF THE DRAWINGS

Preferred embodiments of the arrangement in accordance with the invention have the characteristics mentioned in the subsidiary claims and will be described in more detail in connection with the attached drawings wherein:

FIG. 3 is a strongly enlarged section along line A—A in FIG. 1;

FIG. 4 is a corresponding section along line B—B in FIG. 2;

FIG. 5A is a section corresponding to FIGS. 3 and 4 and shows an intermediate position during the opening of the packing container;

FIG. 5B is a partial sectional view corresponding to the ringed area in FIG. 5A with the cover strip in plane condition.

DETAILED DESCRIPTION OF THE PREFERRED EMBODIMENT

Figure 1:
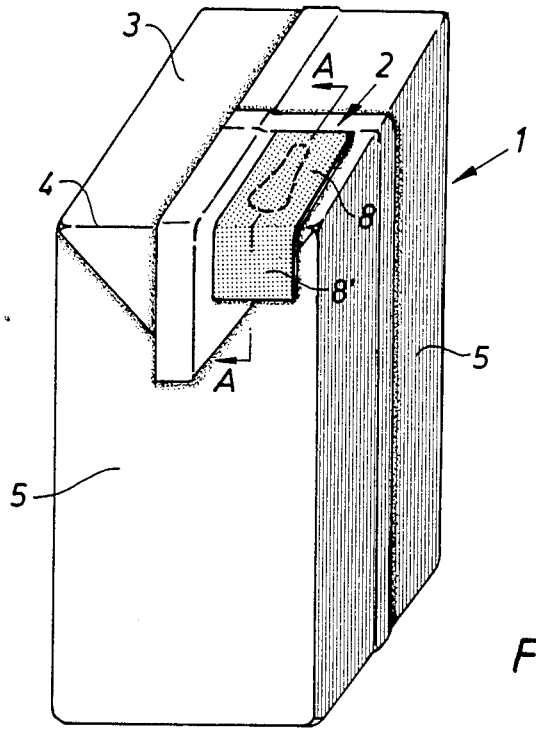
FIG. 1 is a schematic side view of a packing container in accordance with the invention.

In FIG. 1 is shown thus in closed condition an opening arrangement in accordance with the invention on a packing container of known type. The packing container is of the Tetra Brik type (registered trade-mark) which can be manufactured from a flexible laminate comprising layers of paper and thermoplastics. The laminate is fed in the form of a web to a packing machine and is folded to a liquid-tight tube which is filled with the desired contents, e.g. milk. The tube subsequently is processed with the help of sealing jaws, which at equal intervals flatten the material tube so that its wall rests against each other in narrow transverse zones. The material is heated in the said zones with the help of the processing jaws so that the thermoplastic layers melt together thus dividing the material tube into separate, liquid-tight packing containers. The packing containers subsequently are severed from one another by means of transverse cuts in the sealing zones, whereupon they are subjected to a forming process which converts the packing containers to substantially parallelepipedic packing containers.

The known packing container is often provided with an opening arrangement in the form of a prepunched hole with a cover strip applied over the hole. When the packing container is to be opened the cover strip is torn off and the hole functions as a pouring opening through which the packed contents can be emptied out. To make sure that the packing container is completely tight when the cover strip is untouched, the opening arrangement usually comprises a further layer which is responsible for the tightness of the packing container and prevents the contents from issuing out of the pouring opening and reaching the underside of the cover strip. This layer either may be in the form of a separate, liquid-tight strip which is sealed to the inside of the packing material in a liquid-tight seal extending around the pouring opening, or else it may constitute one of the thermoplastic layers of the packing container and thus extend over the whole surface of the packing material. The latter form of realization can be achieved in that the hole forming the pouring opening is punched out in connection with the formation of the laminate before the carrier layer of the packing laminate is provided with outer thermoplastic layers. In both forms of realization the area of the liquid-tight layer situated within the edge line of the pouring opening is sealed to the underside of the cover strip, so that at the same time as the cover strip is removed it becomes possible also to break the liquid-tight layer so that the contents become accessible.

Figure 2:
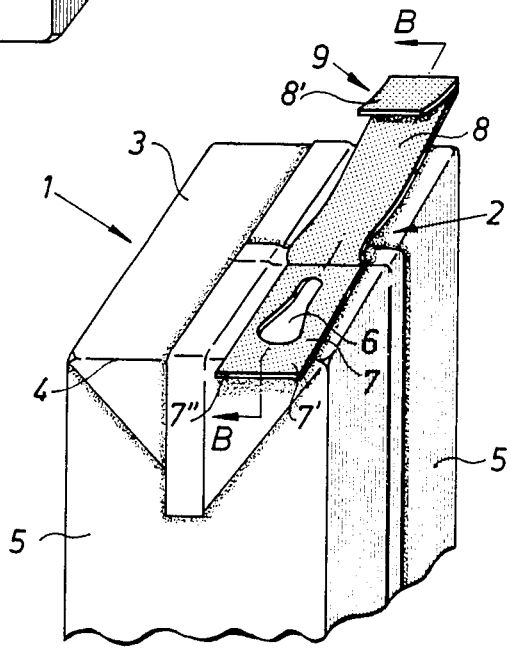
FIG. 2 is a corresponding side view of the top part 1 of the packing container shown in FIG. 1 with an opening arrangement in open position.

As shown in FIGS. 1 and 2 an opening arrangement of a packing container 1 usually is placed on the upper side 3 of the container 1, preferably adjoining one of the edges 4 which delimit the upper side 3 of the packing container 1 from adjacent sidewalls 5. The opening arrangement 2 comprises a pouring opening 6 punched out of the upper side 3 of the packing container, whose size and shape can be adapted to the type of contents which the packing container is intended for. On the upper side 3 of the packing container 1 is also provided a preferably stiff pouring edge strip 7 which in the area around the pouring opening 6 is sealed to the upper side 3 and which has a front end or pouring tab 7' projecting a few millimeters over the container edge 4 forming a pouring edge 7'' which facilitates the pouring out of the contents. The opening arrangement 2 comprises, moreover, a pouring opening 6 and a cover strip 8 forming a breakable closure of the pouring edge strip 7, which has a front end or pull-tab 8' which extends over the container edge 4 and which in closing position of the cover strip 8 (as shown in FIG. 1) is folded down all around the pouring edge 7'' to form a breakable seal with the sidewall 5. To make possible a simple reclosing of the pouring opening 6 once the packing container 1 has been broken open, the opening arrangement in accordance with the invention comprises a gripping element 9 which is adapted to provide a detachable gripping of the pouring tab 7' when the cover strip is returned to the position shown in FIG. 1.

As is evident from FIGS. 3, 4 and 5A–5B the gripping element 9 in accordance with a very simple embodiment may be constituted of a free edge end 9'' of a, preferably stiff, gripping strip 9' applied to the underside of the pull-tab 8' which, when the cover strip 8, once torn off, is returned to its closing position (FIG. 1), grips all around the pouring edge 7'' and hooks onto the underside of the pouring tab 7', as shown in FIG. 3. To facilitate this hooking on it is essential in accordance with the invention that the gripping strip 9' is applied so to the pull-tab 8' that a certain space is formed between the free edge end 9'' and the pouring edge 7'', as shown, in strong enlargement in FIG. 5B with the cover strip 8 folded down in plane condition. In practice this space may be approx. 0.3–0.8 mm, preferably approx. 0.5 mm.

It is further evident from FIGS. 3, 4 and 5A that the rear end of the cover strip 8 and the pouring edge preferably are wedged in and sealed in an overlap joint 10 of container material produced during the manufacture of the packing container 1.

It is well-known that the packing container 1 generally is manufactured from a laminated packing material comprising, for example, a supporting middle layer of paper, with layers of heat-sealable material (e.g. polythene) applied to both sides of the paper and a possible further layer of gas-tight material such as aluminium foil. The pouring edge strip 7 too may be built up of laminated material layers, e.g. an outer layer of polyvinyl chloride (PVC) and a layer of sealable material facing towards the packing container which preferably consists of polythene in the case where the outer layer of the packing material consists of polythene. Alternatively the sealable layer on the pouring edge strip 7 may be an ethylene-vinylacetate (EVA) if this is sealable to the outside of the container. It is also possible, of course, to use any form of hot melt or a suitable sealing varnish. The cover strip 8 also consists of laminated material layers, for example, an outer layer of aluminium foil and a material, e.g. polythene, which is heat-sealable to the upper layer of the pouring edge strip 7.

Since the choice of the individual laminate layers in the packing container 1, the pouring edge strip 7 and the cover strip 8 respectively, in principle, lacks importance insofar as the present invention is concerned, the said components have been indicated in the attached drawings, for the sake of clarity, only in the form of a single layer.

For the finished packing container as a whole, on the other hand, it is important that the seal which is produced between the underside of the pouring edge strip 7 and the upper side of the packing container 1 should be sufficiently strong to withstand any stresses it may be subjected to when the cover strip 8 is torn off. This implies at the same time that the seal between the pouring edge strip 7 and the packing container 1 should be at least equally strong, preferably stronger, that the seal between the pouring edge strip 7 and the cover strip 8. The seal between the pouring edge strip and the cover strip, on the other hand, should be such that it is easily broken when the cover strip is torn off.

Even though, as has been said, the special choice of material layers included in the respective laminate structures, in principle, lacks importance for the invention considered as a whole, provided the abovementioned sealing conditions are met, it is possible (for the case of the packing container 1 being manufactured from a packing material comprising a paper layer with both sides covered with polythene layers) to choose as a practical example of a suitable laminate structure for the cover strip 8 and the pouring edge strip 7 respectively a laminate structure comprising a top layer of aluminium foil with the underside coated with a polythene layer and, respectively, a laminate structure comprising a PVC-layer, with the top side coated with a sealing varnish and the underside covered with a polythene layer, the sealing varnish being of the type which on heat-sealing furnishes a weaker seal between the sealing varnish and the polythene layer of the cover strip than the seal between the polythene layers on the pouring edge strip and the packing container respectively.

As mentioned previously, the gripping element 9 in accordance with the invention preferably consists of a stiff gripping strip 9' which on one side is sealed to the underside (that is to say the polythene layer) of the cover strip 8 and which on the other side, on the unopened packing container 1 (in FIG. 1) forms a breakable seal with the side wall 5 of the packing container (that is to say the outside polythene layer of the packing material in the present example). To make possible repeated reclosures of the packing container 1 once it has been broken open, it is important in accordance with the invention that the seal between the gripping strip 9' and the cover strip 8 should be sufficiently strong to withstand any stress which the seal is subjected to when the the pull-lug 8' is folded around the pouring edge 7''. This means that the seal between the gripping strip 9' and the cover strip consequently should be stronger than the seal between the gripping strip 9' and the sidewall 5 of the packing container 1 on the unopened packing container. In accordance with the discussion conducted above concerning the cover strip, the pouring edge strip and the packing container, it is thus appropriate to use a gripping strip which has the same laminate structure as the said pouring edge strip, that is to say a PVC-layer with the one side coated with a suitable sealing varnish and the other side coated with a polythene layer. In the present case this implies though that the polythene layer of the gripping strip 9' ought to be facing towards the cover strip 8 whereas the sealing varnish consequently should be facing towards the sidewall 5 of the packing container 1.

As is evident, for example, from FIG. 5 an area adjoining the gripping edge 9'' on the gripping strip 9' may be unsealed to the cover strip 8, as a result of which the folding over of the cover strip around the pouring edge 7'' is facilitated when the packing container 1 is to be reclosed.

In the manufacture of a conventional packing container the cover strip and the pouring edge strip usually are applied in the form of a unit which is cut off from a weblike prefabricated laminate strip of coherent cover/pouring edge strips and is applied and sealed to the packing material in the correct position over the prepared pouring opening in connection with the manufacture of the packing container in a packing machine. A similar procedure, using equipment existing already in a conventional packing machine, is made possible in accordance with the invention quite simply by replacing the previous web of coherent cover/pouring edge strips by a corresponding, prefabricated web of coherent cover/pouring edge/gripping strips which are thus cut off, applied and sealed over the prepared pouring opening 6 in the packing machine in connection with the manufacture of the packing container 1. Such a prefabricated web will be especially simple to manufacture in accordance with the invention when the pouring edge strip 7 and the gripping strip 9 are built up of the same material, as mentioned earlier.

In such a method of pouring edge strip 7 and a gripping strip 9' form a detachable and a permanent seal respectively with the one side (that is to say the side which is intended to be facing towards the pouring opening 6) of a cover strip 8, the method in accordance with the invention being characterized by using as a gripping strip 9' a cut-off and reversed edge piece of a strip serving as a preliminary material for the pouring edge strip 7 with a certain surplus width corresponding to the width of the ultimate gripping strip 9'.

In accordance with the invention the edge piece or gripping strip 9', thus cut off and reversed, and the pouring edge strip 7 are sealed to the cover strip 8 so that a space corresponding to 0.3–0.8 mm, preferably 0.5 mm, is formed between the two firstnamed strips 9' and 7 so as to facilitate the folding of the gripping strip 9' around, and the hooking to, the pouring edge strip 7 on reclosing of the finished opening arrangement 2, as has been explained earlier. In accordance with the invention such a hooking is facilitated further in that an area between the cover strip 8 and the gripping strip 9', in connection to the space between the gripping strip 9' and the pouring edge strip 7, is left unsealed.

While this invention has been illustrated and described in accordance with a preferred embodiment, it is recognized that variations and changes may be made and equivalents employed therein without departing from the invention as set forth in the claims.

What is claimed is:

1. In an opening arrangement on a packing container having a pouring opening formed in a container wall, the arrangement including a cover strip having an underside and being an openable closure of the pouring opening and a pouring edge strip arranged between the cover strip and the container wall, the improvement comprising the cover strip being provided with a gripping element in the form of a strip applied to the underside of the cover strip to provide detachable gripping of the pouring edge strip, said gripping element including means for reclosing said opening arrangement.

2. An arrangement in accordance with claim 1, wherein the cover strip has a pull-tab projecting from the container wall, and the gripping strip is applied to an underside of said pull-tab, said gripping element consisting of an end edge of the gripping strip facing towards the container wall.

3. In an opening arrangement on a packing container having a pouring opening formed in a container wall, the arrangement including a cover strip having an underside and being an openable closure of the pouring opening and a pouring edge strip arranged between the cover strip and the container wall, the improvement comprising the cover strip being provided with a gripping element in the form of a strip applied to the underside of the cover strip to provide detachable gripping of the pouring edge strip, said cover strip having a pull-tab projecting from the container wall, and the gripping strip being applied to an underside of said pull-tab, said gripping element consisting of an end edge of the gripping strip facing towards the container wall, the pull-tab with the gripping strip so applied being foldable around a pouring edge on the pouring edge strip projecting from the container wall for hooking the end edge of the gripping strip to the underside of the pouring edge strip.

4. An arrangement in accordance with claim 3, wherein the gripping strip and the pouring edge strip are adapted so that a certain space is formed between the end edge of the gripping strip and the pouring edge of the pouring edge strip.

5. In an opening arrangement on a packing container having a pouring opening formed in a container wall, the arrangement including a cover strip having an underside and being an openable closure of the pouring opening and a pouring edge strip arranged between the cover strip and the container wall, the improvement comprising the cover strip being provided with a gripping element in the form of a strip applied to the underside of the cover strip to provide detachable gripping of the pouring edge strip, said cover strip having a pull-tab projecting from the container wall, and the gripping strip being applied to an underside of said pull-tab, said gripping element consisting of an end edge of the gripping strip facing towards the container wall, the gripping strip and the cover strip being unsealed to each other in an area around the gripping edge of the gripping strip.

6. In an opening arrangement on a packing container having a pouring opening formed in a container wall, the arrangement including a cover strip having an underside and being an openable closure of the pouring opening and a pouring edge strip arranged between the cover strip and the container wall, the improvement comprising the cover strip being provided with a gripping element in the form of a strip applied to the underside of the cover strip to provide detachable gripping of the pouring edge strip, one end of the cover strip being wedged fast in an overlap joint on the upper side of the packing container.

7. A method for the manufacture of a closure over a prepared pouring opening in a packing material of a packing container comprising: providing a cover strip, detachably bonding a pouring edge strip and a gripping strip to said cover strip, applying said pouring edge strip with said cover strip over said pouring opening, said pouring edge strip extending over a corner of said container adjacent said pouring opening, and detachably bonding said gripping strip to a side of said container while attached to said cover strip, whereby the pouring edge strip forms a detachable seal over the pouring opening and the gripping strip forms a permanent seal with the side of the cover strip which is to face towards the packing container, said method including the steps of:

cutting off and subsequently reversing an edge piece of a preliminary material of the pouring edge strip and using the edge piece as a gripping strip.

8. A method in accordance with claim 7, wherein the cut-off and reversed edge piece or gripping strip and the pouring edge strip are sealed to the cover strip so that a space is formed between the gripping strip and the pouring edge strip.

9. A method in accordance with claim 8, wherein an area between the cover strip and the gripping strip in connection to the space between the gripping strip and the pouring edge strip is left unsealed.

10. In an opening arrangement on a packing container having a pouring opening formed in a first container wall adjacent the intersection with a second container wall with an edge between the first and second walls, the improvement comprising a pouring strip having an opening, said strip opening being aligned with said pouring opening in said first wall and secured to said first wall, said pouring strip extending in cantilever relation over said edge, a gripping strip being detachably bonded to said second container wall adjacent said edge, and a cover strip secured to said gripping strip and detachably bonded to said pouring strip, said cover strip cooperating with said pouring strip to form a pull-tab with the gripping strip adjacent the container edge whereby the pouring opening may be opened by pulling the pull-tab to release the gripping strip and to peel the cover strip from the pouring strip.

11. An arrangement in accordance with claim 10, wherein the gripping strip and the pouring edge strip are adapted so that a certain space is formed between the end edge of the gripping strip and the pouring edge of the pouring edge strip.

12. An arrangement in accordance with claim 10, wherein the gripping strip and the cover strip are unsealed to each other in an area around the gripping edge of the gripping strip.

13. An arrangement in accordance with claim 10, wherein one end of the cover strip is wedged fast in an overlap joint on the upper side of the packing container.

* * * * *